US010032377B2

(12) United States Patent
Bartsch

(10) Patent No.: US 10,032,377 B2
(45) Date of Patent: Jul. 24, 2018

(54) PARKING SPACE MANAGEMENT

(71) Applicant: VOLKSWAGEN AKTIENGESELLSCHAFT, Wolfsburg (DE)

(72) Inventor: Patrick Bartsch, Wolfsburg (DE)

(73) Assignee: VOLKSWAGEN AKTIENGESELLSCHAFT (DE)

( * ) Notice: Subject to any disclaimer, the term of this patent is extended or adjusted under 35 U.S.C. 154(b) by 0 days.

(21) Appl. No.: 15/328,513

(22) PCT Filed: Jul. 10, 2015

(86) PCT No.: PCT/EP2015/065849
§ 371 (c)(1),
(2) Date: Jan. 24, 2017

(87) PCT Pub. No.: WO2016/020142
PCT Pub. Date: Feb. 11, 2016

(65) Prior Publication Data

US 2017/0229017 A1 Aug. 10, 2017

(30) Foreign Application Priority Data

Aug. 6, 2014 (DE) ..... 10 2014 215 512

(51) Int. Cl.
*G08G 1/00* (2006.01)
*G08G 1/14* (2006.01)
*G08G 1/16* (2006.01)

(52) U.S. Cl.
CPC ..... *G08G 1/144* (2013.01); *G08G 1/147* (2013.01); *G08G 1/168* (2013.01)

(58) Field of Classification Search
CPC ..... G08G 1/144; G08G 1/147; G08G 1/168
USPC ..... 340/932.2
See application file for complete search history.

(56) References Cited

U.S. PATENT DOCUMENTS 6,466,821 B1 * 10/2002 Pianca ..... A61N 1/36542 607/18
6,738,712 B1 * 5/2004 Hildebrant ..... G01C 21/26 701/431
2003/0162536 A1 8/2003 Panico
2010/0075655 A1 3/2010 Howarter et al.
2011/0140922 A1 6/2011 Levy et al.
(Continued)

FOREIGN PATENT DOCUMENTS

DE 102004062021 A1 7/2006
DE 102009054292 A1 8/2011
(Continued)

OTHER PUBLICATIONS

International Preliminary Report on Patentability for International Patent Application No. PCT/EP2015/065849; dated Feb. 7, 2017.
(Continued)

*Primary Examiner* — Omer S Khan
(74) *Attorney, Agent, or Firm* — Barnes & Thornburg LLP

(57) ABSTRACT

Based on the interaction between a mobile end device and a parked vehicle, it is determined whether a parked car will soon exit a parking space within a period of time. A report is selectively sent to a server in accordance with the determination. The report indicates the imminent exit of the motor vehicle.

12 Claims, 6 Drawing Sheets

(56) References Cited

U.S. PATENT DOCUMENTS

| | | | | |
|---|---|---|---|---|
| 2012/0056758 | A1* | 3/2012 | Kuhlman | G08G 1/14 340/932.2 |
| 2012/0200430 | A1 | 8/2012 | Spahl | |
| 2012/0262305 | A1 | 10/2012 | Woodard et al. | |
| 2013/0103200 | A1 | 4/2013 | Tucker et al. | |
| 2013/0290045 | A1* | 10/2013 | Levy | G07B 15/02 705/5 |

FOREIGN PATENT DOCUMENTS

| | | | |
|---|---|---|---|
| DE | 102011122191 | A1 | 6/2012 |
| EP | 2267681 | A1 | 12/2010 |
| TW | 201030689 | A | 8/2010 |
| WO | 2008132520 | A1 | 11/2008 |
| WO | 2014016841 | A1 | 1/2014 |
| WO | 2014072909 | A1 | 5/2014 |

OTHER PUBLICATIONS

Search Report for German Patent Application No. 10 2014 215 512.6; dated May 21, 2015.

Search Report for International Patent Application No. PCT/EP2015/065849; dated Sep. 25, 2015.

* cited by examiner

PARKING SPACE MANAGEMENT

PRIORITY CLAIM

This patent application is a U.S. National Phase of International Patent Application No. PCT/EP2015/065849, filed 10 Jul. 2015, which claims priority to German Patent Application No. 10 2014 215 512.6, filed 6 Aug. 2014, the disclosures of which are incorporated herein by reference in their entirety.

SUMMARY

Illustrative embodiments relate to a method for indicating an imminent exit from a parking space by a parked motor vehicle and a corresponding device. Illustrative embodiments also relate to a method for performing a parking space exchange between a parked motor vehicle and a further motor vehicle. The illustrative embodiments relate to parking space management techniques which take account of whether the exit from the parking space by the parked motor vehicle is imminent within a time period.

BRIEF DESCRIPTION OF THE DRAWINGS

The disclosed embodiments are explained in conjunction with the attached figures.

DETAILED DESCRIPTION OF THE DISCLOSED EMBODIMENTS

Figure 1:
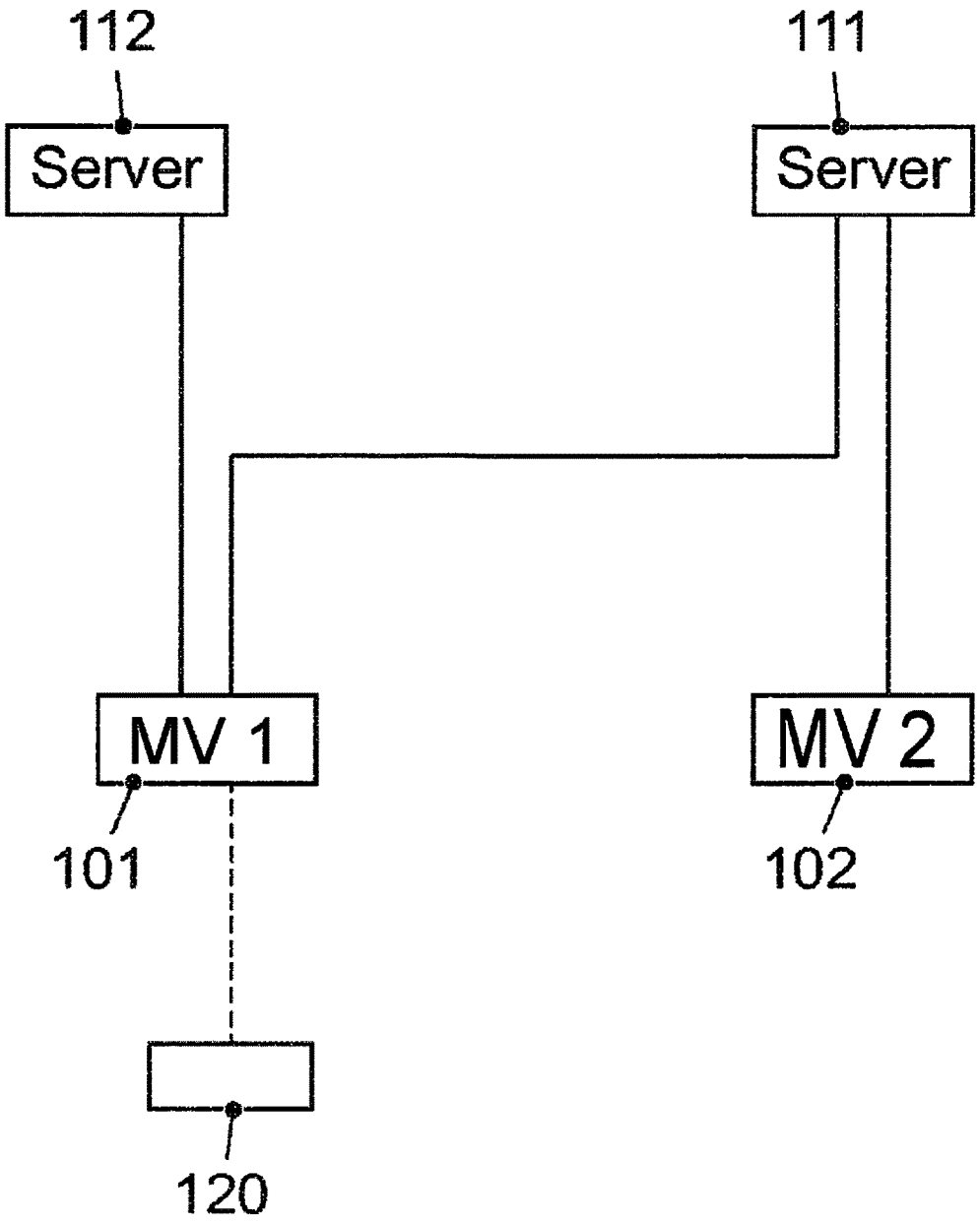
FIG. 1 shows a schematic view of a parked motor vehicle and a further motor vehicle searching for a parking space, wherein the parked motor vehicle and the further motor vehicle searching for a parking space have a communication connection to a server, wherein the parked motor vehicle also has a communication connection to a mobile terminal device'

With increasing individual mobility, the number of motor vehicles is increasing constantly, particularly in conurbations. Situations frequently arise in which available parking spaces for motor vehicles are not available or are available to a limited extent only. This may necessitate a time-consuming and costly parking space search.

Parking space management techniques are known in which such a supply of parking spaces is matched with a demand for parking spaces. For example, it is known from document US 2003/0162536 A1 that a parked motor vehicle indicates an immediately imminent exit from a parking space. A further vehicle searching for a parking space can then take over the freed up parking space; a transfer of the parking space takes place. A parking space exchange is thus achieved.

However, techniques of this type have certain restrictions. For example, it may be necessary for a direct transfer of the parking space to take place between the parked motor vehicle and the further motor vehicle searching for a parking space. This may require that the exit from the parking space of the previously parked motor vehicle is temporally synchronized with the entry into the parking space of the further motor vehicle searching for a parking space. This temporal synchronization is typically comparatively complex and may cause waiting times or delays. On the whole, the number of available parking spaces thus decreases.

The need therefore exists for improved parking space management techniques. A need exists for techniques which overcome some or all of the aforementioned restrictions.

Disclosed embodiments relate to a method for indicating an imminent exit from a parking space by a parked motor vehicle. The method comprises the check to determine whether an exit from a parking space by the motor vehicle is prospectively imminent within a time period. The check is based on an interaction between a mobile terminal device and the parked motor vehicle. The method furthermore comprises the selective dispatch of a message to a server depending on the check. The message indicates the imminent exit from the parking space.

The mobile terminal device may, for example, be a Smartphone, a tablet PC, a portable navigation device, a laptop, a Smartwatch, etc. The mobile terminal device may, for example, be associated with a user of the parked motor vehicle; the user of the mobile terminal device may, for example, be the user of the parked motor vehicle. During the interaction between the mobile terminal device and the parked motor vehicle, an authentication of the user of the mobile terminal device in relation to the parked motor vehicle may furthermore take place. It can thus be ensured that an authorized user, during the interaction between the mobile terminal device and the parked motor vehicle, provides information on the basis of which the check is carried out to determine whether the exit from the parking space is imminent.

During the interaction, the method may furthermore comprise, for example: dispatching a control message from the mobile terminal device to the parked motor vehicle; and/or dispatching a control message from the parked motor vehicle to the mobile terminal device. The control message may, for example, indicate different information relating to an operating condition of the mobile terminal device and/or an operating condition of the parked motor vehicle.

The control message may, for example, be dispatched wirelessly. To do this, different transmission technologies can be used, such as, for example, a mobile communications network and/or Wireless Local Network (WLAN) technology. Generally speaking, it may therefore be possible for the mobile terminal device to provide the parked motor vehicle with information during the interaction between the mobile terminal device and the parked motor vehicle; it may also be possible for the parked motor vehicle to provide the mobile terminal device with information; it is also possible for both the mobile terminal device to provide the parked motor vehicle with information and for the parked motor vehicle to provide the mobile terminal device with information. Accordingly, it is possible for the check to determine whether the exit from the parking space is imminent to take place totally or partially in the mobile terminal device or the parked motor vehicle. It would also be possible for different logic operations to be distributed during the check between the mobile terminal device and the parked motor vehicle.

It is possible, for example, for the time period to be predefined. It would also be possible for the time period to be averaged during the interaction between the mobile terminal device and the parked motor vehicle. It would also be possible for the time period to be defined depending on a user input. The time period may, for example, be in the order of magnitude of minutes or 10 minutes or a plurality of tens of minutes. For example, the time period may be: 1 minute, 2 minutes, 5 minutes, 10 minutes or 20 minutes.

For example, the message can be sent selectively to the server if it is established that the exit from the parking space is imminent within the time period. It may thus be possible to dispatch the message before the exit from the parking space is executed or becomes possible. In other words, the message can prospectively indicate the imminent exit from the parking space. It may thus be possible to inform motor vehicles searching for parking spaces of the prospectively imminent exit from the parking space at an early stage. In connection with parking space management techniques, it may thus be possible to guide further motor vehicles searching for parking spaces to a position of the parked motor vehicle before the parked motor vehicle actually departs from the parking space. A delay between the vacating of the parking space and the re-occupancy of the parking space by the further motor vehicle searching for a parking space can thus be reduced.

It may be unnecessary for a temporally synchronized direct transfer between the previously parked motor vehicle and the further motor vehicle searching for a parking space to take place at the parking space. This may be the case, since the provisionally required time until the further vehicle searching for a parking space reaches the parking space can be synchronized with the time period of the prospective notification of the exit from the parking space. A probability for the occupancy of the parking space by a third motor vehicle may then be comparatively low. It may therefore be unnecessary to take special measures to keep the parking space free until the arrival of the further vehicle searching for a parking space. This can simplify the parking space management technology.

It is generally also possible for different techniques to be used during the check to determine whether the exit from the parking space by the motor vehicle is prospectively imminent within the time period. The check can be carried out depending on different criteria and information.

The method may furthermore comprise, for example, the determining of a distance between the motor vehicle and the mobile terminal device during the interaction between the mobile terminal device and the parked motor vehicle. The check may furthermore comprise the performance of a threshold value comparison between the determined distance and a predefined threshold value. The dispatch of the message can be performed selectively depending on the threshold value comparison.

The dispatch of the message may be performed, for example, if the threshold value comparison indicates that the distance between the motor vehicle and the mobile terminal device is less than the predefined threshold value. This may then mean that a probability that the exit from the parking space is imminent within the time period is comparatively high. This may in fact indicate that a user who is carrying the mobile terminal device with him is coming comparatively close to the motor vehicle.

During the determination of the distance between the motor vehicle and the mobile terminal device, one or more control messages, for example, can be exchanged between the motor vehicle and the mobile terminal device. The one or more control messages may, for example, indicate a position of the motor vehicle and/or the mobile terminal device. It may then be possible to define the distance between the motor vehicle and the mobile terminal device comparatively accurately. The distance may be defined, for example, as a linear distance between the position of the motor vehicle and a position of the mobile terminal device. Alternatively or additionally, it would also be possible for the distance to be defined as an effective distance between the position of the motor vehicle and the position of the mobile terminal device. The effective distance may, for example, take account of specific obstacles between the position of the mobile terminal device and the position of the motor vehicle, such as, for example, road layouts, etc. It would also be possible for the effective distance to take account of a route previously used by the user of the mobile terminal device between the position of the motor vehicle and the position of the mobile terminal device. By means of such techniques, it is possible to predict accurately and reliably whether the exit from the parking space is imminent within the time period.

It is also possible for the method furthermore to comprise the determination of a movement profile of the mobile terminal device. The check may furthermore be based on the movement profile of the mobile terminal device.

The movement profile may correspond, for example, to a variation over time in the position of the mobile terminal device. For example, the position of the mobile terminal device may be checked at specific time intervals. A check can then be carried out to determine whether the position of the mobile terminal device is static or comparatively dynamic for each time interval. If the position of the mobile terminal device is, e.g., comparatively dynamic in relation to the historical movement profile or in relation to a predefined reference value, for example, this may indicate an increased probability that the exit from the parking space by the motor vehicle is prospectively imminent within the time period. This may in fact indicate that the user who is carrying the mobile terminal device with him has left a specific location and is now on the move. During the determination of the movement profile, a direction of movement of the mobile terminal device can also be taken into account. An average direction of movement, for example, may be taken into account. The averaging may take account of a continuous time average. A comparatively dynamic movement profile in conjunction with a direction of movement which is oriented in the direction of the position of the motor vehicle may, for example, indicate an increased probability that the exit from the parking space by the motor vehicle is prospectively imminent within the time period. A check can therefore be carried out comparatively accurately and reliably by means of such techniques to determine whether the exit from the parking space by a motor vehicle is prospectively imminent within the time period.

The method may furthermore comprise, for example: transferring a position of the motor vehicle and/or a position of the mobile terminal device between the motor vehicle and the mobile terminal device during the interaction between the mobile terminal device and the parked motor vehicle. The determination of the movement profile of the mobile terminal device may take place relatively with reference to the position of the parked motor vehicle. A check can be carried out, for example, to determine whether a time average of the position of the mobile terminal device (predominant area of the movement profile) of the position of the motor vehicle is approaching or moving away. The check to determine whether the exit from the parking the motor vehicle is prospectively imminent within the time period can thus take place accurately and reliably.

The method may furthermore comprise, for example, the transmission of a control message between the mobile terminal device and the motor vehicle during the interaction between the mobile terminal device and the parked motor vehicle. The control message may indicate an operating condition of a motor vehicle component. The control message may indicate, for example, one or more operating conditions of the following group: a state of charge of a drive battery of the motor vehicle; an activation of an air conditioning unit of the motor vehicle; and an opening of a locking mechanism. The control message may therefore indicate operating conditions of motor vehicle components which are modifiable by means of remote control, for example, by means of the mobile terminal device. A modification of a corresponding operating condition may indicate an increased probability that the exit from the parking space by the motor vehicle is prospectively imminent within the time period. A full or almost full state of charge of the drive battery of the motor vehicle may indicate, for example, that a restart and therefore the exit from the parking space by the motor vehicle is soon to be imminent. An activation of the air conditioning unit of a motor vehicle, for example, the auxiliary heater or auxiliary ventilation, may indicate that the user would soon like to move the motor vehicle, i.e., that the exit from the parking space by the motor vehicle is imminent within the time period. The same applies to the opening of the locking mechanism of the motor vehicle. Further information relating to the check to determine whether the exit from the parking space is prospectively imminent can be taken into account by taking account of the operating conditions of the motor vehicle component. A more accurate check can thus take place.

Generally speaking, further or different information can be taken into account during the check to determine whether the exit from the parking space is imminent.

It would be possible, for example, for the method furthermore to comprise: determining, on the basis of a journey log book of a navigation system of the motor vehicle, a probability that the exit from the parking space by the motor vehicle will be imminent within the time period. The check may furthermore comprise, for example: performing a threshold value comparison between the determined probability and a predefined threshold value, wherein the dispatch of the message is carried out selectively depending on the threshold value comparison. The journey log book of the navigation system may indicate, for example, specific historical preferences of the user. The journey log book may indicate specific times at which the exit from the parking space by the motor vehicle takes place with a comparatively high probability. Corresponding times would be, for example: leaving a home location of the user on the way to work; leaving a work location of the user on the way home; etc.

The method may furthermore comprise, for example: determining a remaining parking time of the motor vehicle by communicating with a parking space charging server. The selective dispatch of the message may furthermore take place depending on the checking of the remaining parking time. In the case of parking spaces subject to charges, the parking space charging server may, for example, provide information relating to an end time of the parking. If this end time falls within the time period, the exit from the parking space by the motor vehicle may take place within this time period with a comparatively high probability. If, for example, the user extends the remaining parking time by communicating with the parking space charging server by means of the mobile terminal device, it can be inferred, in the case of a remaining parking time that is not immediately imminent, that the probability of the imminent exit from the parking space within the time period is comparatively low.

It would furthermore be possible for the method furthermore to comprise: checking an appointment calendar of the user of the mobile terminal device. The selective dispatch of the message can furthermore take place depending on the checking of the appointment calendar.

Various scenarios have been illustrated above in which a wide variety of information relating to the motor vehicle and/or the mobile terminal device is used to check whether the exit from the parking space by the motor vehicle is prospectively imminent within the time period. The parked motor vehicle and the mobile terminal device interact for this purpose. The prospective indication of the imminent exit from the parking space can thus take place accurately.

It may be possible for the message furthermore to indicate the time period. It may thus be possible in connection with the parking space management techniques to guide further motor vehicles searching for parking spaces to the position of the parked motor vehicle in a targeted and selective manner depending on the indicated time period. The indicated time period may be correlated with the distance between the respective further motor vehicle searching for a parking space and the parked motor vehicle. It is also possible for the method furthermore to comprise the definition of the time period on the basis of a distance between the parked motor vehicle and a further motor vehicle searching for a parking space. A targeted check can thus be carried out in connection with the parking space management techniques to determine whether the parked motor vehicle is eligible for a parking space exchange with the further motor vehicle searching for a parking space.

Disclosed embodiments also relate to a device which is configured to indicate an imminent exit from a parking space by a parked motor vehicle. The device comprises a processing unit. The processing unit is configured to check whether an exit from a parking space by the motor vehicle is prospectively imminent within a time period on the basis of an interaction between a mobile terminal device and the parked motor vehicle. The device furthermore comprises an interface which is configured to dispatch a message selectively to a server depending on the check. The message indicates the imminent exit from the parking space.

The device according to the presently discussed embodiment may be configured, for example, to carry out the method for indicating an imminent exit from a parking space according to a further disclosed embodiment.

For such a device according to the presently discussed effect, effects can be achieved which are comparable to the effects which can be achieved for the method for indicating an imminent exit from a parking space according to a further disclosed embodiment.

The discussion above has focused primarily on techniques which relate to the prospective indication of the imminent exit from a parking space. Such techniques can be used for the efficient performance of a parking space exchange in connection with parking space management techniques.

Disclosed embodiments also relate to a method for performing a parking space exchange between a parked motor vehicle and a further motor vehicle. The method comprises the reception of a supply message from a server. The supply message indicates an imminent exit from a parking space by the parked motor vehicle and a position of the parked motor vehicle. The method furthermore comprises, in response to the reception of the supply message: selective dispatch of an acceptance message to the server. The acceptance message acknowledges the imminent parking space exchange between the parked motor vehicle and the further motor vehicle.

In other words, the acknowledgement of the imminent parking space exchange can thus be carried out before the parking space exchange is actually carried out by the exit from the parking space by the parked motor vehicle and the entry into the parking space of the further motor vehicle previously searching for a parking space. Delays in the parking space exchange can thus be reduced. It may be unnecessary for a direct transfer of the parking space to take place between the previously parked motor vehicle and the further motor vehicle previously searching for a parking space. On the whole, the number of available parking spaces can thus be increased, since parking times can be reduced.

It is possible, for example, for the supply message furthermore to indicate a time period within which the exit from the parking space is prospectively imminent. Accordingly, it would be possible, for example, for the dispatch of an acceptance message to be carried out selectively depending on the time period. The time period indicated by the supply message may, for example, be compared with a further time period which is required to reach the position of the parked motor vehicle on the basis of the position of the further motor vehicle searching for a parking space. The length of the delay between the exit from the parking by the parked motor vehicle and the entry into the parking space of the further motor vehicle searching for a parking space can thus be checked. If this delay is, for example, greater than a predefined threshold value, the dispatch of the acceptance message to the server may not be carried out. This may be the case because a probability that the parking space previously occupied by the parked motor vehicle will still be free at the time of the arrival of the further motor vehicle searching for a parking space at the position of the parking space is comparatively low.

Disclosed embodiments also relate to a device which is configured to perform a parking space exchange between a parked motor vehicle and a further motor vehicle. The device comprises an interface which is configured to receive a supply message from a server. The supply message indicates an imminent exit from a parking space by the parked motor vehicle and a position of the parked motor vehicle. The interface is furthermore configured to dispatch an acceptance message selectively to the server in response to the reception of the supply message. The acceptance message acknowledges the imminent parking space exchange between the parked motor vehicle and the further motor vehicle.

The device according to the presently discussed embodiment may be configured, for example, to carry out the method for performing a parking space exchange according to a further disclosed embodiment.

For such a device according to the presently discussed embodiment, effects can be achieved which are comparable to the effects which can be achieved for the method for performing the parking space exchange according to a further disclosed embodiment.

Different embodiments which have been discussed above can be combined with one another. It is possible for different embodiments relating to the indication of the imminent exit from a parking space to be combined with different embodiments relating to the performance of the parking space exchange.

In the figures, the same reference numbers denote the same or similar elements. The figures are schematic representations of different disclosed embodiments. Elements shown in the figures are not necessarily drawn to scale. Instead, the different elements shown in the figures are reproduced in such a way that their function and general purpose is understandable to the person skilled in the art. Connections and links shown in the figures between functional units and elements can also be implemented as an indirect connection or link. A connection or link may be implemented in a wired or wireless manner. Functional units can be implemented as hardware, software or a combination of hardware and software.

Different embodiments are illustrated below in connection with parking space management techniques. The techniques illustrated below enable an exit from a parking space to be prospectively indicated. It can thus be possible for the parking space exchange between a parked motor vehicle and a further motor vehicle searching for a parking space to be acknowledged prospectively. The parking space exchange does not have to be carried out through direct transfer between the motor vehicle leaving the parking space and the motor vehicle entering the parking space, since a delay between leaving the parking space and the arrival of the vehicle entering the parking space can be reduced. Furthermore, a targeted guidance of the further motor vehicle searching for a parking space to the position of the parked motor vehicle can take place. If a plurality of further motor vehicles searching for parking spaces are present in the vicinity of the parked motor vehicle, a suitable further motor vehicle searching for a parking space can be selected, for example, depending on a time period within which the exit from the parking space by the parked motor vehicle is imminent, and can be guided to the position of the parked motor vehicle. Delays in the parking space exchange can thus be reduced. This increases an average availability of parking spaces.

According to the techniques described herein, the check to determine whether an exit from a parking space by the motor vehicle is prospectively imminent within the time period may be based on an interaction between a mobile terminal device of a user of the parked motor vehicle and the parked motor vehicle itself. Information can be obtained through this interaction which enables an accurate and reliable check to determine whether the exit from the parking space by the motor vehicle is imminent. Errors in checking whether the exit from the parking space is prospectively imminent within the time period can thus be reduced; as a result, delays can in turn be reduced in the parking space management, thereby increasing an average availability of parking spaces.

It may furthermore be possible by means of the techniques described herein to indicate the imminent exit from a parking space automatically or partially automatically. It may not be necessary for the imminent exit from a parking space to be indicated in response to a user input of a user of the parked motor vehicle. Imminent exits from parking spaces by different motor vehicles can thus be more reliably and frequently detected and indicated on average, which may in turn increase an availability of parking spaces.

FIG. 1 shows schematically the parked motor vehicle 101 and the further motor vehicle 102 searching for a parking space. The parked motor vehicle 101 and the further motor vehicle 102 searching for a parking space have a communication connection to a server 111. The server 111 performs parking space management techniques. The server 111 can be configured to coordinate a parking space exchange between the parked motor vehicle 101 and the further motor vehicle 102 searching for a parking space. To do this, the server 111 can match the imminent availability of the parking space on which the motor vehicle 101 is parked with the parking space requirement of the further motor vehicle 102. FIG. 1 also shows a parking space charging server 112. The parking space charging server 112 administers parking spaces that are subject to a charge.

The server 111 can use different techniques to match the supply of available parking spaces as closely as possible with the demand for parking spaces. It would be possible, for example, for the supply of and demand for parking spaces to be quantified by a virtual currency. If, for example, a user approaches his destination, he can start a request for free parking spaces, e.g., on his mobile terminal device. The server 111 can provide the user with an overview of possible parking spaces which are considered by the system to be free and accessible. For example, parking spaces for which a message has been received by the server 111 a sufficiently short time previously, indicating an imminent exit from a parking space by a parked motor vehicle 101, can be considered to be free parking spaces. It is possible to filter the accessibility to corresponding parking spaces by means of a virtual currency. A parking space may thus relate, for example, to the availability in the destination area. It would be possible, for example, for fewer costs to be incurred in a city center on a public holiday or Sunday afternoon than during main business hours. In this respect, it would be possible for the server 111 to keep an account with the aforementioned virtual currency for each user. If a user exits from a parking space or a corresponding exit from a parking space is prospectively imminent within the time period, this can be indicated to the server 111 by means of a message. Here, the message can be dispatched by the corresponding parked motor vehicle 101 or by the mobile terminal device 120. The message may be dispatched in an automatic, partially automatic or user-initiated manner. A specific amount of the virtual currency can then be credited to the corresponding user to the account kept with the server 111. The manual initiation of the dispatch of the message indicating the imminent exit from a parking space may be effected, for example, via a corresponding input in an application which is run on the mobile terminal device, such as, for example, a click on a button or similar. The automatic or partially automatic dispatch of the message indicating the imminent exit from a parking space may be triggered, for example, by activating an infotainment system of the parked motor vehicle or other criteria and operating conditions of motor vehicle components. Further criteria would be, for example, information obtained during an interaction between the mobile terminal device 120 and the parked motor vehicle 101. Such criteria may indicate a comparatively high probability that the exit from a parking space will take place within the time period. It is also possible for the dispatch of the message indicating the imminent exit from the parking space to be triggered by an approach of the mobile terminal device and therefore the user to the parked motor vehicle.

It would be possible, for example, when an imminent exit from a parking space is reported, for a payment to be made as a credit of an amount of the virtual currency to the account of the respective user kept with the server 111. For example, the payment can be specified depending on the available spaces in the vicinity of the parked motor vehicle. For example, the fewer parking spaces there are available in the area, the higher the amount of the payment could be.

It would optionally be possible for a user, after parking the motor vehicle in a parking space, to send a corresponding message to the server 111 indicating the performed entry into a parking space. The server 111 can then mark the corresponding parking space as unavailable. For this purpose, it may also be possible for the user to receive a payment as a credit of an amount in the virtual currency to the account kept with the server 111.

It may therefore be possible for a marketplace for parking space information to be created by means of such techniques. The provision of corresponding information relating to the availability of parking spaces by the users can be supported by the personal benefit of the filling of a personal account in the virtual currency. It can be achieved as an effect that a more accurate and more reliable performance of parking space management techniques is enabled. Delays in parking space exchange procedures can be reduced. Available free parking spaces can be better indicated.

Figure 2:
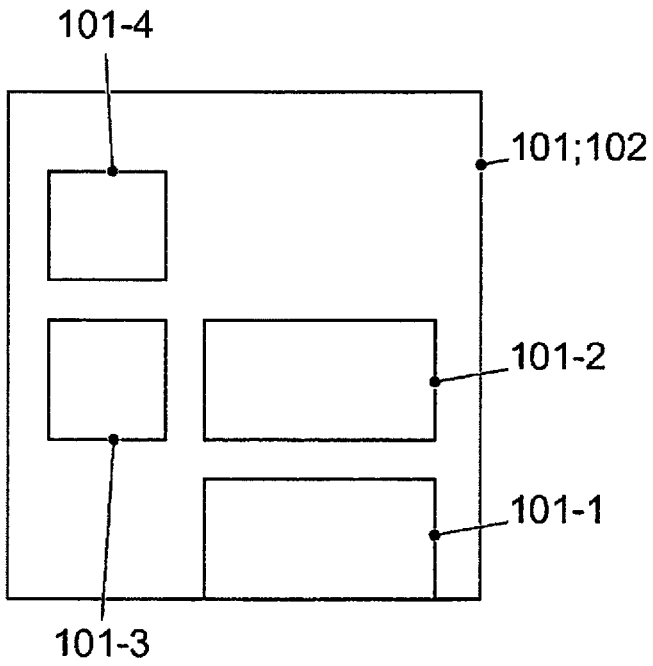
FIG. 2 is the schematic view of the parked motor vehicle and the further motor vehicle searching for a parking space of FIG. 1 in greater detail.

FIG. 2 shows schematically in greater detail the parked motor vehicle 101 and the further motor vehicle 102 searching for a parking space. The motor vehicles 101, 102 have a processing unit 101-2 which is configured to perform different techniques in connection with parking space management. A memory 101-3 may be configured, for example, to store different control commands which are executed by the processor 101-2. The processor 101-2 may be configured, for example, to check whether an exit from a parking space by the motor vehicle 101, 102 is prospectively imminent within a time period. The motor vehicles 101, 102 furthermore have an interface 101-1 which is configured to establish a communication connection to the mobile terminal device 120. The motor vehicles 101, 102 furthermore have a navigation system 101-4 which, for example, keeps a journey log book.

Figure 3:
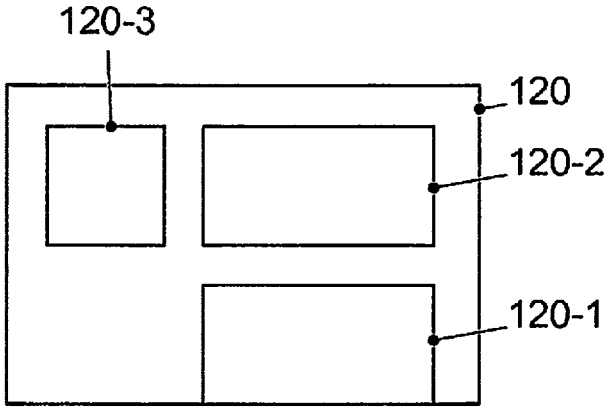
FIG. 3 is the schematic view of the mobile terminal device of FIG. 1 in greater detail.

FIG. 3 shows a schematic view of the mobile terminal device 120. The mobile terminal device 120 has an interface 120-1 which is configured to communicate with a motor vehicle 101, 102 of the user of the mobile terminal device 120. The corresponding communication connection may be established, for example, wirelessly via WLAN technology or a mobile communications network. The mobile terminal device 120 furthermore comprises a processor 120-2. The processor 120-2 is configured to perform different processing operations in connection with the parking space management techniques. The processor 120-2 may be configured, for example, to execute different control commands which are stored in a memory 120-3. The control commands may relate, for example, to different techniques in connection with the check to determine whether an exit from a parking space by the parked motor vehicle 101 is prospectively imminent within the time period.

As illustrated above, both the parked motor vehicle 101 and the mobile terminal device 120 have the capability to perform different processing operations in connection with the check to determine whether the exit from a parking space by the motor vehicle 101 is prospectively imminent within the time period. Accordingly, the associated logic can be implemented totally or partially by the parked motor vehicle or the mobile terminal device 120.

Figure 4:
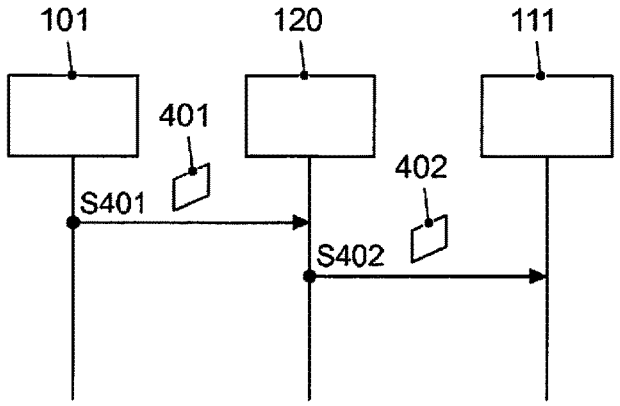
FIG. 4 is a signal flow diagram of a technique for indicating an imminent exit from a parking space according to disclosed embodiments.

FIG. 4 shows a signal flow diagram of a method for indicating an imminent exit from a parking space. In operation at S401, the motor vehicle 101 first sends a control message 401 to the mobile terminal device 120. Different information may be contained in the control message 401. It would be possible, for example, for the control message 401 to contain information relating to the position of the parked motor vehicle 101. Alternatively or additionally, it would be possible for the control message 401 to indicate an operating condition of a motor vehicle component of the motor vehicle 101. The control message 401 could indicate, for example, a state of charge of a drive battery of the motor vehicle 101. Alternatively or additionally, the control message 401 could also indicate that an air conditioning unit, such as, for example, an auxiliary heater or ventilation, of the motor vehicle 101 has been activated. Alternatively or additionally, the control message 401 could also indicate that a locking mechanism of the motor vehicle 101 has been opened. On the basis of such and further information, it is then possible for the processor 120-2 of the mobile terminal device 120 to check whether the exit from a parking space by the motor vehicle 101 is prospectively imminent within the time period. If so, the interface 120-1 of the mobile terminal device 120 sends the message 402 in operation at S402 indicating the imminent exit from a parking space.

Figure 5:
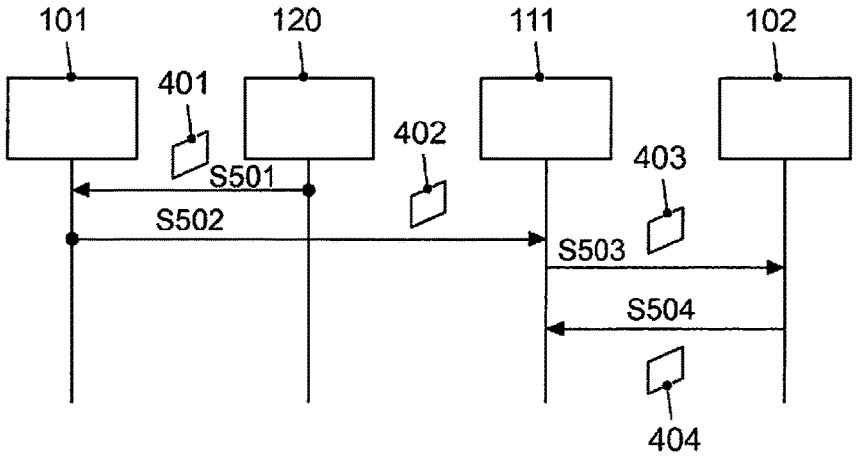
FIG. 5 is a signal flow diagram of a technique for indicating an imminent exit from a parking space according to disclosed embodiments and also a technique for performing a parking space exchange according to disclosed embodiments.

FIG. 5 shows a signal flow diagram of a method for indicating an imminent exit from a parking space according to a further implementation. In operation at S501, the control message 401 is sent from the mobile terminal device 120 to the parked motor vehicle 101. The control message 401 may in turn contain different information. The control message 401 may contain, for example, a position of the mobile terminal device, for example, in an absolute coordinate system or relatively with reference to a position of the parked motor vehicle 101. Alternatively or additionally, it would also be possible for the control message 401 to contain a movement profile of the mobile terminal device 120. The movement profile may correspond, for example, to a variation over time in the position of the mobile terminal device 120. Alternatively or additionally, the control message 401 could furthermore contain, for example, information indicating that a user of the mobile terminal device 120 has recently extended a remaining parking time of the parked motor vehicle 101 by communicating with the parking space charging server 112. On the basis of such and further information, it is then possible for the processor 101-2 of the parked motor vehicle 101 to be configured to check whether the exit from a parking space by the motor vehicle 101 is prospectively imminent within the time period. If so, the message 402 is sent to the server 111 in operation at S502. The message 402 in turn indicates the imminent exit from a parking space.

On the basis of the message 402, it is then possible for the server 111 to be configured to locate a further motor vehicle 102 searching for a parking space in connection with parking space management techniques, the further vehicle being able to perform the parking space exchange with the parked motor vehicle 101. To do this, the server 111 sends the supply message 403 in operation at S503 to the further motor vehicle 102 searching for a parking space. The supply message 403 indicates the imminent exit from a parking space by the parked motor vehicle 101. The supply message 403 furthermore indicates the position of the parked motor vehicle 101. The further motor vehicle 102 searching for a parking space then replies by dispatching an acceptance message 404 to the server 111 in operation at S504. The acceptance message 404 acknowledges the imminent parking space exchange between the parked motor vehicle 101 and the further motor vehicle 102 searching for a parking space. It would be possible, for example, for the server 111 to be configured to re-assess the availability of the corresponding parking space in connection with parking space management techniques in response to the reception of the acceptance message 404. The server 111 could furthermore initiate a credit or debit in a virtual currency to the user of the parked motor vehicle 101 and/or the user of the further motor vehicle 102 searching for a parking space.

Figure 6:
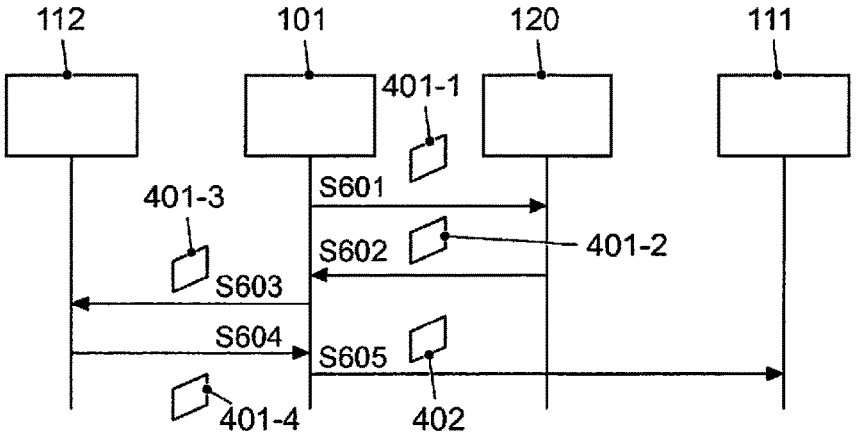
FIG. 6 is a signal flow diagram of different techniques for indicating an imminent exit from a parking space according to disclosed embodiments.

FIG. 6 shows a signal flow diagram of a further implementation of a method for indicating an imminent exit from a parking space. In operations at S601 and S602, the parked motor vehicle 101 and the mobile terminal device 120 exchange a first control message 401-1 and a second control message 401-2. It may thus be possible for different information on the basis of which the check to determine whether the exit from a parking space by the motor vehicle 101 is imminent to be exchanged bidirectionally between the parked motor vehicle 101 and the mobile terminal device 120. The check to determine whether the exit from a parking space is imminent can thus be performed accurately and reliably. The parked motor vehicle 101 then sends a request to the parking space charging server 112 by dispatching a further control message 401-3 (operation at S603) to ascertain whether a remaining parking time is available for the parked motor vehicle 101. The parking space charging server 112 replies with a further control message 404-4 (operation at S604). The further control message 401-4 indicates the available remaining parking time. In the scenario shown in FIG. 6, the available remaining parking time is less than the predefined time period for which a check is carried out to determine whether an exit from a parking space by the parked motor vehicle 101 is imminent. The parked motor vehicle 101 therefore dispatches the message 402 in operation at S605 indicating the imminent exit from the parking space. Here, for example, the journey log book of the navigation system 101-4 could additionally be taken into account to further validate the result of the check. Generally speaking, a wide range of different information can be taken into account in checking whether the exit from a parking space is imminent.

Figure 7:
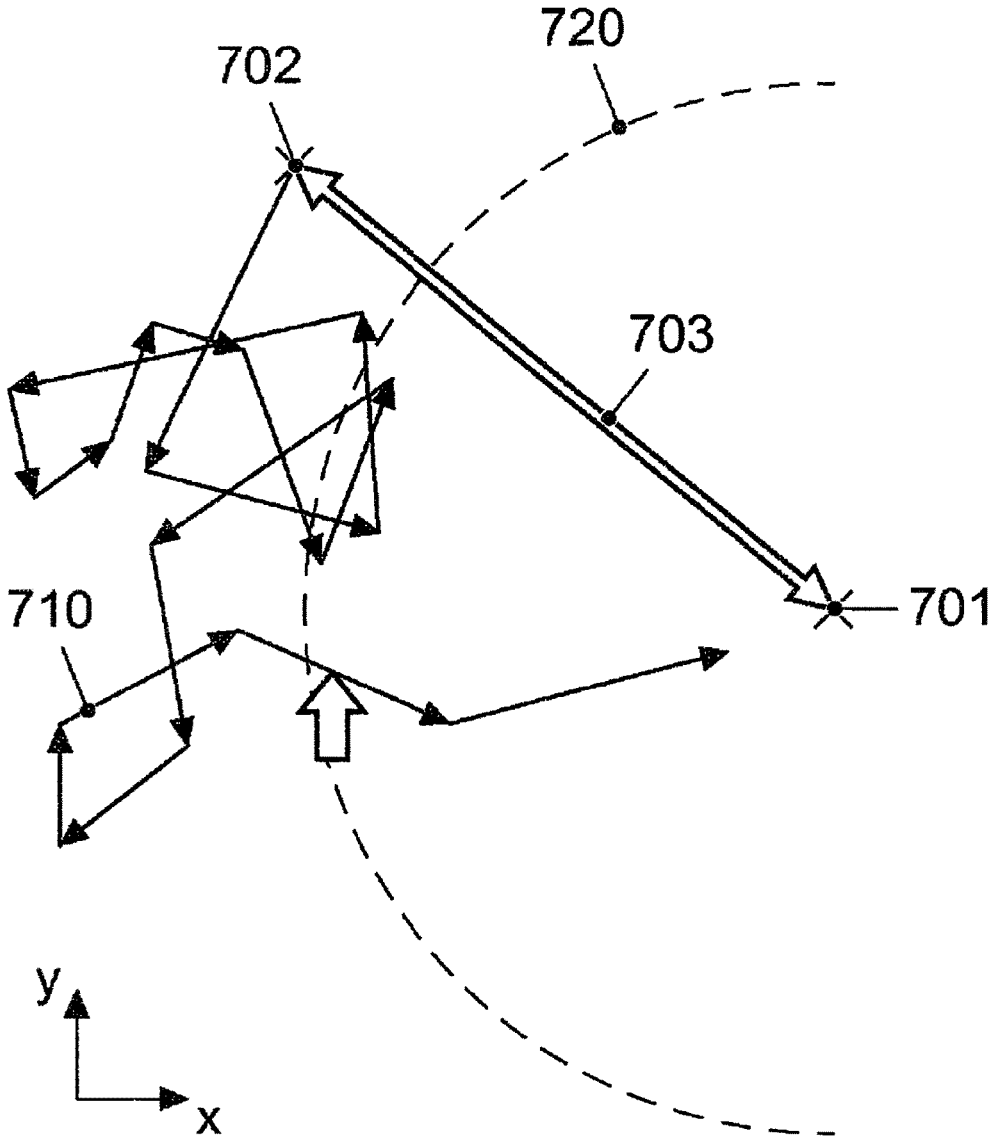
FIG. 7 illustrates a movement profile of a mobile terminal device in relation to a position of a parked motor vehicle.

FIG. 7 shows a scenario in which a check is carried out on the basis of a distance 703 between a position 701 of the parked motor vehicle 101 and a position 702 of the mobile terminal device 120 to determine whether the exit from a parking space by the motor vehicle 101 is imminent within the time period. However, since the distance 703 is greater than a predefined threshold value 720, the check indicates that the exit from a parking space by the motor vehicle 101 is not imminent within the time period.

The position 702 of the mobile terminal device 120 then changes as a function of time. This is shown by a movement profile 710 of the mobile terminal device 120. As is evident from FIG. 7, the movement profile 710 is characterized by a variation over time in the positions 702, specified at discrete times.

It is furthermore evident from FIG. 7 that the distance 703 briefly falls below the predefined threshold value 720. However, since the predominant area of the movement profile 710 does not fall below the threshold value 720, the check in turn indicates that the exit from a parking space by the motor vehicle 101 is not imminent within the predefined time period. The predominant area of the movement profile 710 can be defined, for example, by a continuous average time value of the position 702 of the mobile terminal device 720.

In FIG. 7, a vertically solid arrow indicates the position 702 of the mobile terminal device 120 at which the check indicates that the exit from a parking space by the motor vehicle 101 is imminent within the predefined time period. This is the case since both the movement profile 710 indicates a movement of the mobile terminal device 120 toward the position 701 of the parked motor vehicle 101 and the distance 703 falls below the predefined threshold value 720. The predominant area of the movement profile 710 also falls below the threshold value 720.

Figure 8:
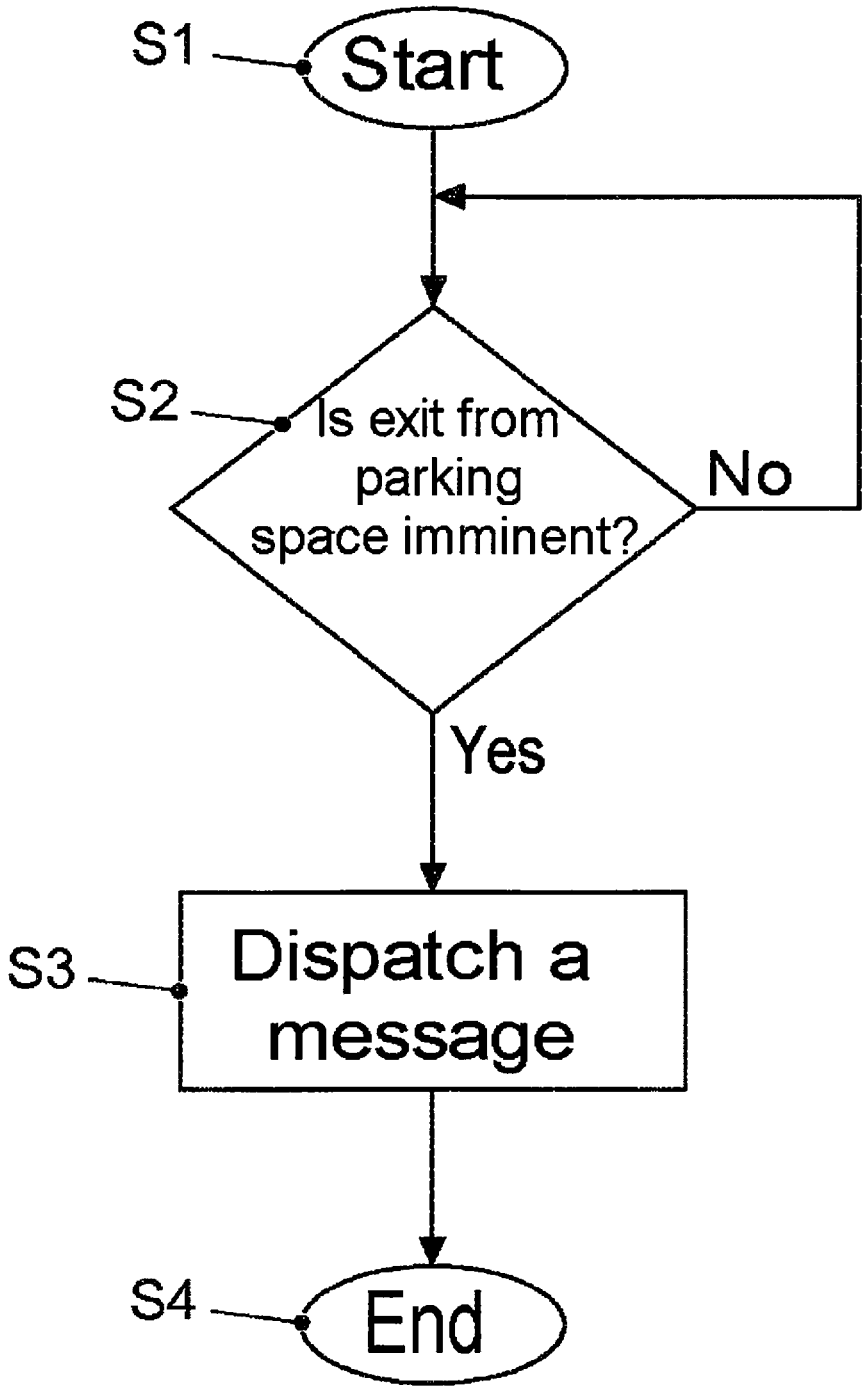
FIG. 8 is a flow diagram of a method for indicating an imminent exit from a parking space according to disclosed embodiments.

FIG. 8 shows a flow diagram of a method for indicating an imminent exit from a parking space according to different disclosed embodiments. The method may be implemented, for example, totally or partially, e.g., in the mobile terminal device 120 and/or in the parked motor vehicle 101-1 and/or the server 111. The method begins in operation at S1. In operation at S2, a check is carried out to determine whether the exit from a parking space is prospectively imminent within the time period. In operation at S2, a wide variety of information can be taken into account. For example, the distance 703 between the motor vehicle 101 and the mobile terminal device 120 can be taken into account in operation at S2. Alternatively or additionally, a direction of movement of the mobile terminal device 120 can be taken into account in operation at S2. Alternatively or additionally, a remaining parking time of the parked motor vehicle 101 can be taken into account in operation at S3. Alternatively or additionally, it would also be possible to take a journey log book of the navigation system 101-4 of the parked motor vehicle 101 into account in operation at S2. For example, an appointment calendar of the user which is stored in the memory 120-3 of the mobile terminal device 120 could also be taken into account in operation at S2.

If the check in operation at S2 indicates that the exit from a parking space by the parked motor vehicle is imminent within the predefined time period, the message 402 is dispatched to the server 111 in operation at S3. The message indicates the imminent exit from a parking space. Optionally, the message 402 may furthermore indicate the predefined time period and/or the position 701 of the parked motor vehicle 101. The method ends in operation at S4.

Figure 9:
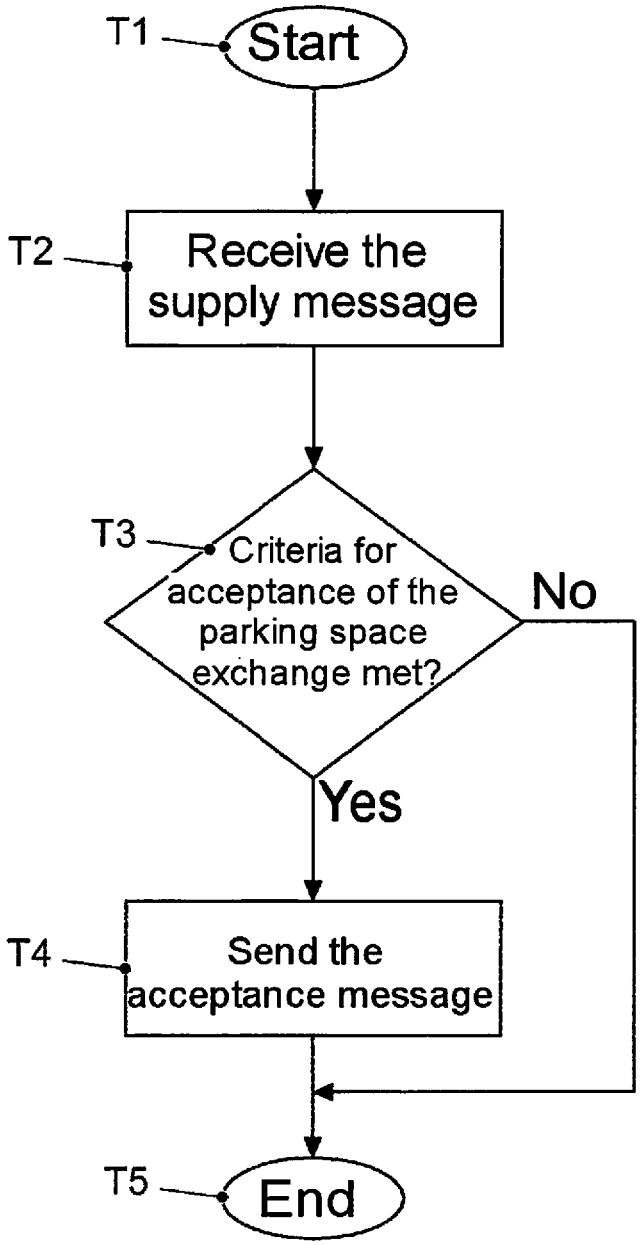
FIG. 9 is a flow diagram of a method for performing a parking space exchange according to disclosed embodiments.

FIG. 9 shows a flow diagram of a method for performing a parking space exchange which can be implemented in the further motor vehicle 102 searching for a parking space. The method begins in operation at T1. The further motor vehicle 102 searching for a parking space first receives the supply message 403. The supply message 403 indicates the imminent exit from a parking space by the parked motor vehicle 101 and furthermore indicates the position 701 of the parked motor vehicle 101. A check is carried out in operation at T3 to determine whether a criterion for the acceptance of the parking space exchange is met. For example, in operation at T3, a distance between a position of the further motor vehicle 102 searching for a parking space and the position 701 of the parked motor vehicle 101 could be correlated with the predefined time period. If the criterion for the acceptance of the parking space exchange is met in operation at T3, the acceptance message 404 is sent to the server 111 in operation at T4. The acceptance message 404 acknowledges the imminent parking space exchange between the further motor vehicle 102 searching for a parking space and the parked motor vehicle 101. The method ends in operation at T5.

The disclosed embodiments described above can obviously be combined with one another. The disclosed embodiments can be used not only in the combinations described, but also in other combinations, or can be taken separately.

REFERENCE NUMBER LIST

101 Parked motor vehicle
101-1, 120-1 Interface
101-2, 120-2 Processing unit
101-3, 120-3 Memory
101-4 Navigation system
102 Further motor vehicle searching for a parking space
111 Server
112 Parking space charging server
120 Mobile terminal device
401, 401-1-401-4 Control message
402 Message
403 Supply message
404 Acceptance message
701, 702 Position
703 Distance
710 Movement profile
720 Threshold value
S401-404 Method operations
S501-504 Method operations
S601-605 Method operations
S1-S4 Method operations
T1-T5 Method operations

The invention claimed is:

1. A method for indicating an imminent exit from a parking space by a parked motor vehicle, the method comprising:

determining a movement profile of a mobile terminal device, where the movement profile comprises a continuous time-averaged direction of movement of the mobile terminal device;

checking, based on each of (i) an interaction between the mobile terminal device and the parked motor vehicle, and (ii) a predominant area of the movement profile of the mobile terminal device is within a threshold value, whether an exit from a parking space by the motor vehicle is prospectively imminent within a time period; and selectively dispatching a message to a server depending on the check, indicating the imminent exit from the parking space;

wherein the predominant area of the movement profile is a continuous average time value of a position of the mobile terminal device;

determining a distance between the motor vehicle and the predominant area of the movement profile of the mobile terminal device during the interaction between the mobile terminal device and the parked motor vehicle, wherein the checking further comprises: performing a threshold value comparison between the determined distance and the threshold value, wherein the dispatch of the message is performed selectively depending on the threshold value being greater than the determined distance.

2. The method of claim 1, further comprising: transferring a position of the motor vehicle or the position of the mobile terminal device between the motor vehicle and the mobile terminal device during the interaction between the mobile terminal device and the parked motor vehicle, wherein the determination of the movement profile of the mobile terminal device takes place relatively with reference to the position of the parked motor vehicle.

3. The method of claim 1, further comprising:

transmitting a control message between the mobile terminal device and the motor vehicle during the interaction between the mobile terminal device and the parked motor vehicle, wherein the control message indicates an operating condition of a motor vehicle component.

4. The method of claim 1, further comprising:

defining the time period based on a distance between the parked motor vehicle and a further motor vehicle searching for a parking space.

5. A device configured to indicate an imminent exit from a parking space by a parked motor vehicle, the device comprising:

a processing unit configured to:

check whether an exit from a parking space by the motor vehicle is prospectively imminent within a time period based on each of (i) an interaction between a mobile terminal device and the parked motor vehicle, and (ii) a predominant area of a movement profile of the mobile terminal device is within a threshold value, determine the movement profile of a mobile terminal device, wherein the movement profile comprises a continuous time-averaged direction of movement of the mobile terminal device, and an interface configured to dispatch a message selectively to a server depending on the check, wherein the message indicates the imminent exit from the parking space;

wherein the predominant area of the movement profile is a continuous average time value of a position of the mobile terminal device;

the processing unit is further configured to:

determine a distance between the motor vehicle and the predominant area of the movement profile of the mobile terminal device during the interaction between the mobile terminal device and the parked motor vehicle, check a threshold value comparison between the determined distance and the threshold value, wherein the dispatch of the message is performed selectively depending on the threshold value being greater than the determined distance.

6. The device of claim 5, wherein the device is configured to carry out a method comprising: determining the movement profile of the mobile terminal device, where the movement profile comprises the time-averaged direction of movement of the mobile terminal device;

checking, based on each of (i) the interaction between the mobile terminal device and the parked motor vehicle, and (ii) the movement profile of the mobile terminal device, whether the exit from the parking space by the motor vehicle is prospectively imminent within the time period; and selectively dispatching the message to the server depending on the check, indicating the imminent exit from the parking space.

7. The device of claim 5, wherein the device is configured to carry out a method comprising: determining a distance between the motor vehicle and the mobile terminal device during the interaction between the mobile terminal device and the parked motor vehicle, wherein the check comprises: performing a threshold value comparison between the determined distance and a predefined threshold value, wherein the dispatch of the message is performed selectively depending on the threshold value comparison.

8. The device of claim 5, wherein the device is configured to carry out a method comprising: transferring a position of the motor vehicle or the position of the mobile terminal device between the motor vehicle and the mobile terminal device during the interaction between the mobile terminal device and the parked motor vehicle, wherein the determination of the movement profile of the mobile terminal device takes place relatively with reference to the position of the parked motor vehicle.

9. The device of claim 5, wherein the device is configured to carry out a method comprising: transmitting a control message between the mobile terminal device and the motor vehicle during the interaction between the mobile terminal device and the parked motor vehicle, wherein the control message indicates an operating condition of a motor vehicle component.

10. The device of claim 5, wherein the device is configured to carry out a method comprising: defining the time period based on a distance between the parked motor vehicle and a further motor vehicle searching for a parking space.

11. The device of claim 1, wherein checking is based on a calendar of the user of the mobile terminal device.

12. The device of claim 5, wherein the processing unit is configured to check whether an exit from the parking space by the motor vehicle is prospectively imminent within the time period based on a calendar of the user of the mobile terminal device.

* * * * *